US011480347B2

(12) United States Patent
Shaffer

(10) Patent No.: US 11,480,347 B2
(45) Date of Patent: Oct. 25, 2022

(54) AIR CONDITIONING APPLIANCE WITH MAKE-UP AIR MODULE

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/915,167

(22) Filed: Jun. 29, 2020

(65) Prior Publication Data

US 2021/0404671 A1 Dec. 30, 2021

(51) Int. Cl.

| | |
|---|---|
| ***F24F 1/028*** | (2019.01) |
| ***F24F 1/0323*** | (2019.01) |
| ***F24F 1/029*** | (2019.01) |
| ***F24F 13/06*** | (2006.01) |
| ***F24F 1/0358*** | (2019.01) |
| ***F24F 1/0373*** | (2019.01) |

(Continued)

(52) U.S. Cl.

CPC ..... *F24F 1/028* (2019.02); *F24F 1/029* (2019.02); *F24F 1/035* (2019.02); *F24F 1/0323* (2019.02); *F24F 1/0358* (2019.02); *F24F 1/0373* (2019.02); *F24F 13/06* (2013.01); *F24F 13/28* (2013.01); *F24F 2013/202* (2013.01); *F24F 2013/205* (2013.01)

(58) Field of Classification Search

CPC ..... F24F 1/028; F24F 1/0358; F24F 1/0373; F24F 1/0323; F24F 1/029; F24F 1/035; F24F 13/06; F24F 13/28; F24F 2013/205; F24F 2013/202

See application file for complete search history.

(56) References Cited

U.S. PATENT DOCUMENTS

| | | | | |
|---|---|---|---|---|
| 4,513,809 | A * | 4/1985 | Schneider | F24F 12/001 165/909 |
| 7,628,026 | B1 * | 12/2009 | Kritsky | F25B 5/02 62/200 |
| 9,696,044 | B2 * | 7/2017 | Shaffer | F24F 1/027 |
| 9,841,198 | B2 * | 12/2017 | Junge | F24F 11/83 |
| 9,927,134 | B2 * | 3/2018 | Beilfuss | F24F 11/83 |

(Continued)

FOREIGN PATENT DOCUMENTS

| | | |
|---|---|---|
| CN | 208186557 U | 12/2018 |
| EP | 3193091 A1 | 7/2017 |
| WO | WO2019061955 A1 | 4/2019 |

*Primary Examiner* — Frantz F Jules

*Assistant Examiner* — Martha Tadesse

(74) *Attorney, Agent, or Firm* — Dority & Manning, P.A.

(57) ABSTRACT

A single-package air conditioning appliance includes a housing defining an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. The single-package air conditioner unit also includes a make-up air module. The make-up air module extends between the outdoor portion of the housing and an outside of the housing. The make-up air module includes a plurality of make-up air fans.

20 Claims, 5 Drawing Sheets

(51) Int. Cl.

| | |
|---|---|
| ***F24F 1/035*** | (2019.01) |
| ***F24F 13/28*** | (2006.01) |
| *F24F 13/20* | (2006.01) |

(56) References Cited

U.S. PATENT DOCUMENTS

| | | | | |
|---|---|---|---|---|
| 2012/0324928 | A1* | 12/2012 | Durham | G05B 13/0205 96/397 |
| 2013/0167577 | A1* | 7/2013 | Street | F24F 13/10 62/408 |
| 2015/0258488 | A1* | 9/2015 | Meirav | F24F 7/065 96/144 |
| 2016/0106008 | A1* | 4/2016 | Cotton | H05K 7/20836 62/304 |
| 2017/0067655 | A1* | 3/2017 | Shaffer | F24F 13/15 |
| 2017/0115014 | A1* | 4/2017 | Junge | F24F 11/83 |
| 2017/0198934 | A1* | 7/2017 | Shaffer | F24F 1/027 |
| 2018/0335220 | A1 | 11/2018 | Dhummi | |
| 2018/0335223 | A1* | 11/2018 | Rissler | F24F 1/027 |
| 2019/0008076 | A1* | 1/2019 | Ghadiri Moghaddam | F24F 3/044 |
| 2019/0145655 | A1* | 5/2019 | Conrad | F24F 7/065 165/119 |

* cited by examiner

AIR CONDITIONING APPLIANCE WITH MAKE-UP AIR MODULE

FIELD OF THE INVENTION

The present subject matter relates generally to air conditioning appliances, and more particularly to make-up air modules for air conditioning appliances.

BACKGROUND OF THE INVENTION

Air conditioner or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Make-up air, e.g., additional fresh air from outside of the building, is typically provided either with a large separate system remote from the air conditioner or with make-up air components internal to the air conditioner. Conventional separate systems can be costly. Conventional internal systems must be relatively small due to limited volume within the air conditioner, which may result in limited capacity of the make-up air system.

As a result, further improvements to air conditioners may be advantageous. In particular, it would be useful to provide an air conditioner with an integrated make-up air module.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner unit, e.g., an SPVU or PTAC, is provided. The single-package air conditioner unit defines a mutually-perpendicular vertical direction, lateral direction, and transverse direction. The single-package air conditioner unit includes a housing defining an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. The single-package air conditioner unit also includes a make-up air module that extends between the outdoor portion of the housing and an outside of the housing. The make-up air module includes a fan box within the outdoor portion, a plurality of make-up air fans positioned in the fan box, and an outlet above the housing along the vertical direction.

In another exemplary aspect of the present disclosure, a single-package air conditioner unit is provided. The single-package air conditioner unit includes a housing that defines an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. The single-package air conditioner unit also includes a make-up air module. The make-up air module extends between the outdoor portion of the housing and an outside of the housing. The make-up air module includes a plurality of make-up air fans.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
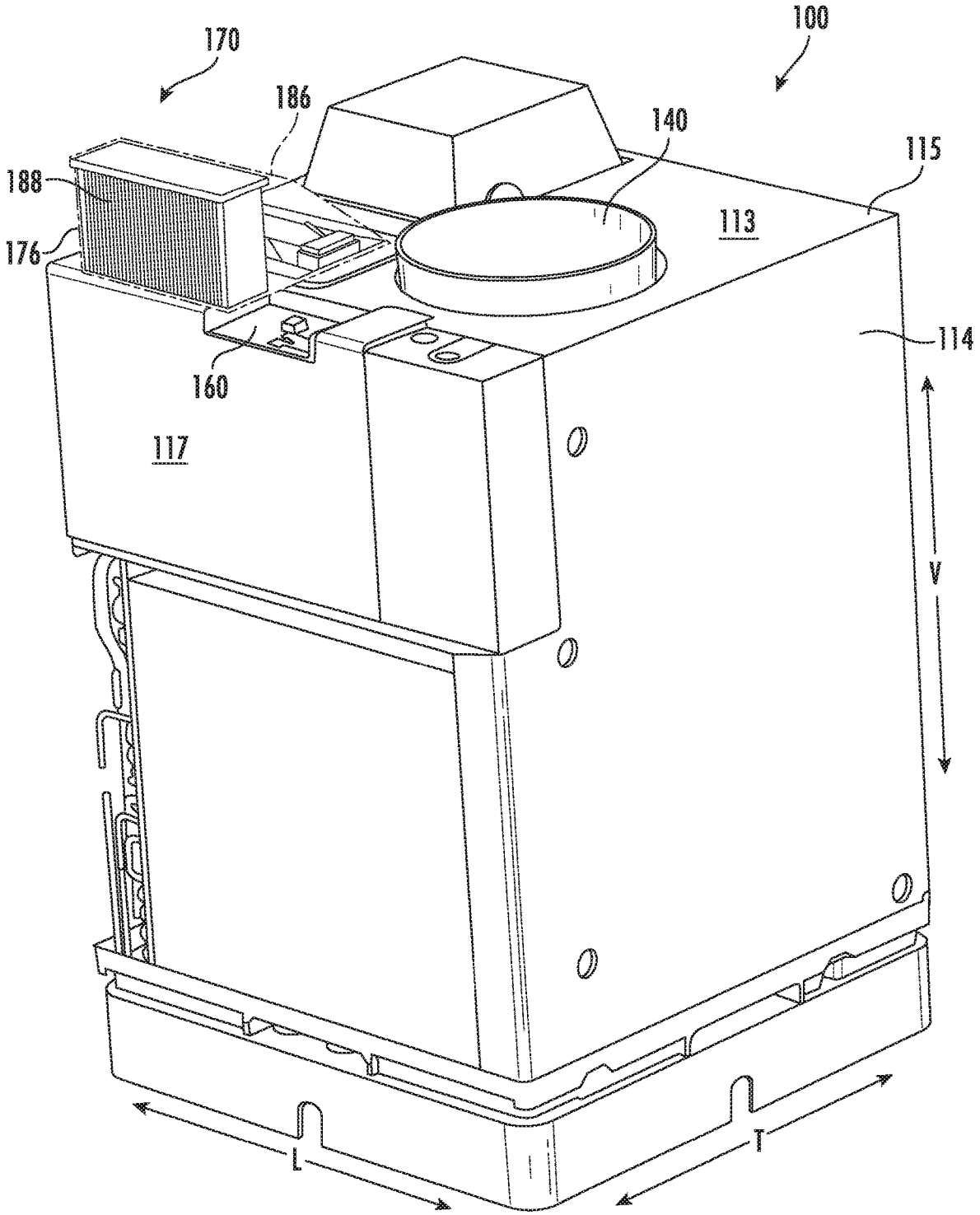
FIG. 1 provides a perspective view of an air conditioning appliance according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
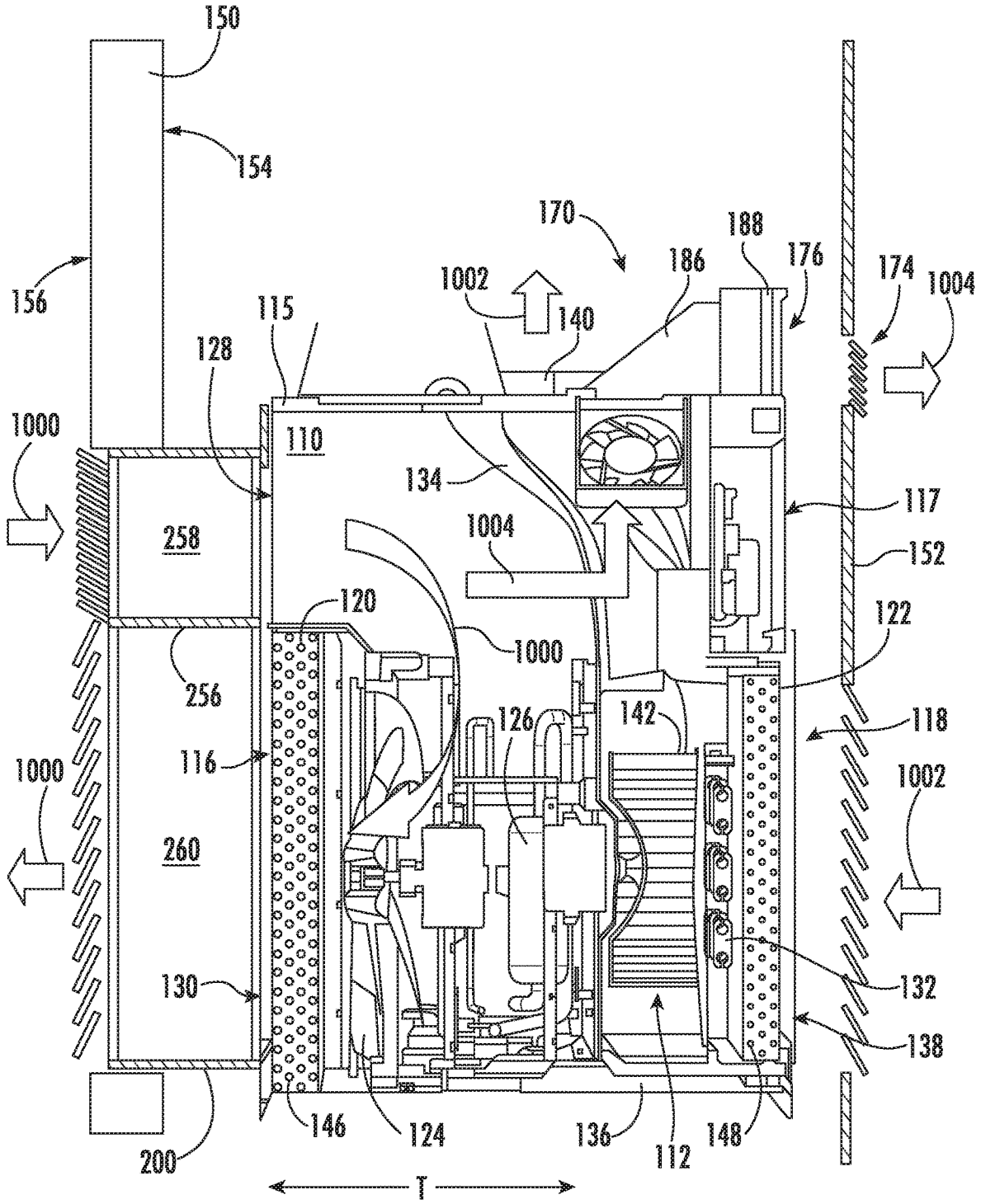
FIG. 2 provides a transverse cross section view of the exemplary air conditioner unit of FIG. 1.
Figure 3:
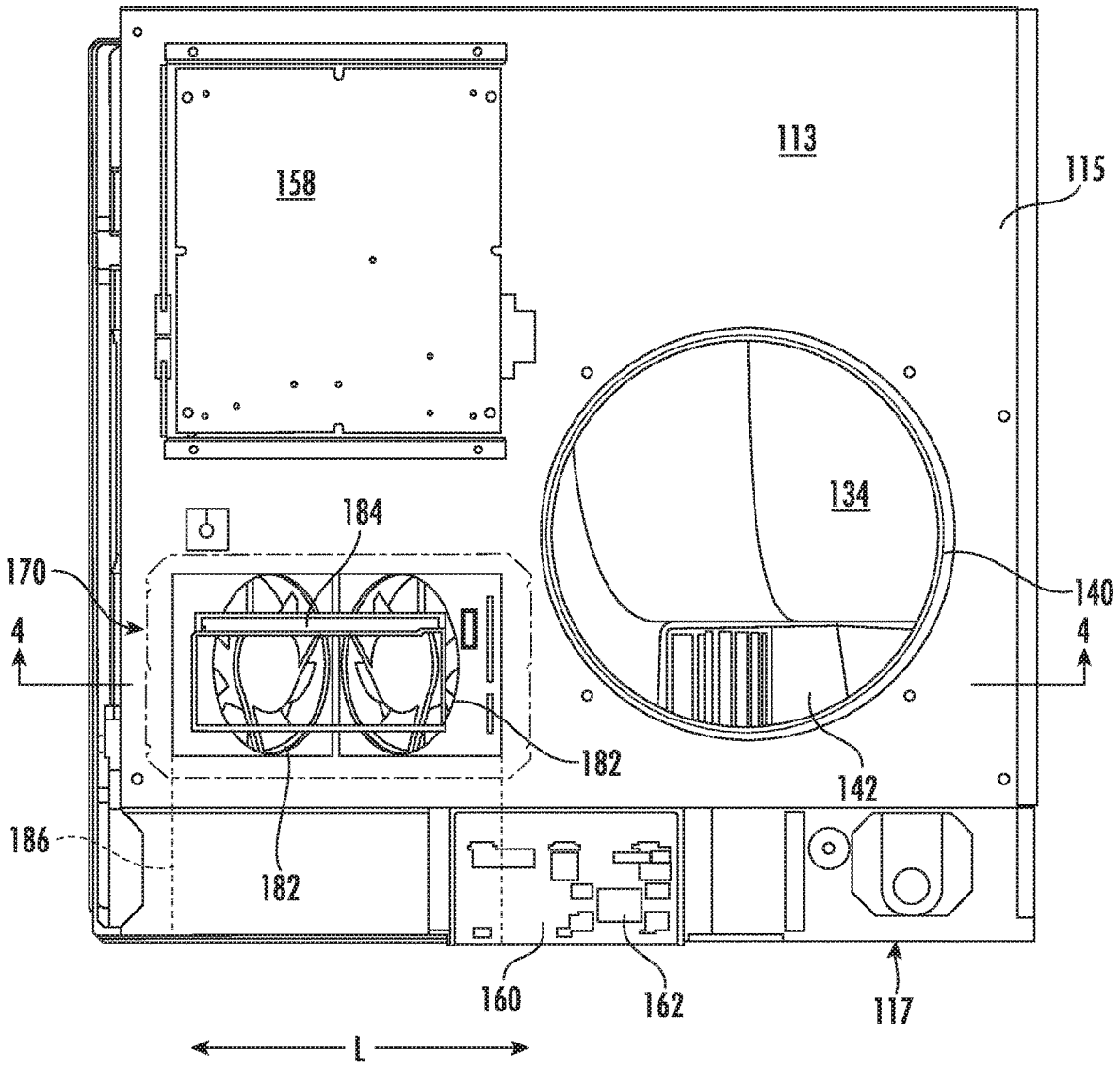
FIG. 3 provides a top down view of the exemplary air conditioner unit of FIG. 1.
Figure 4:
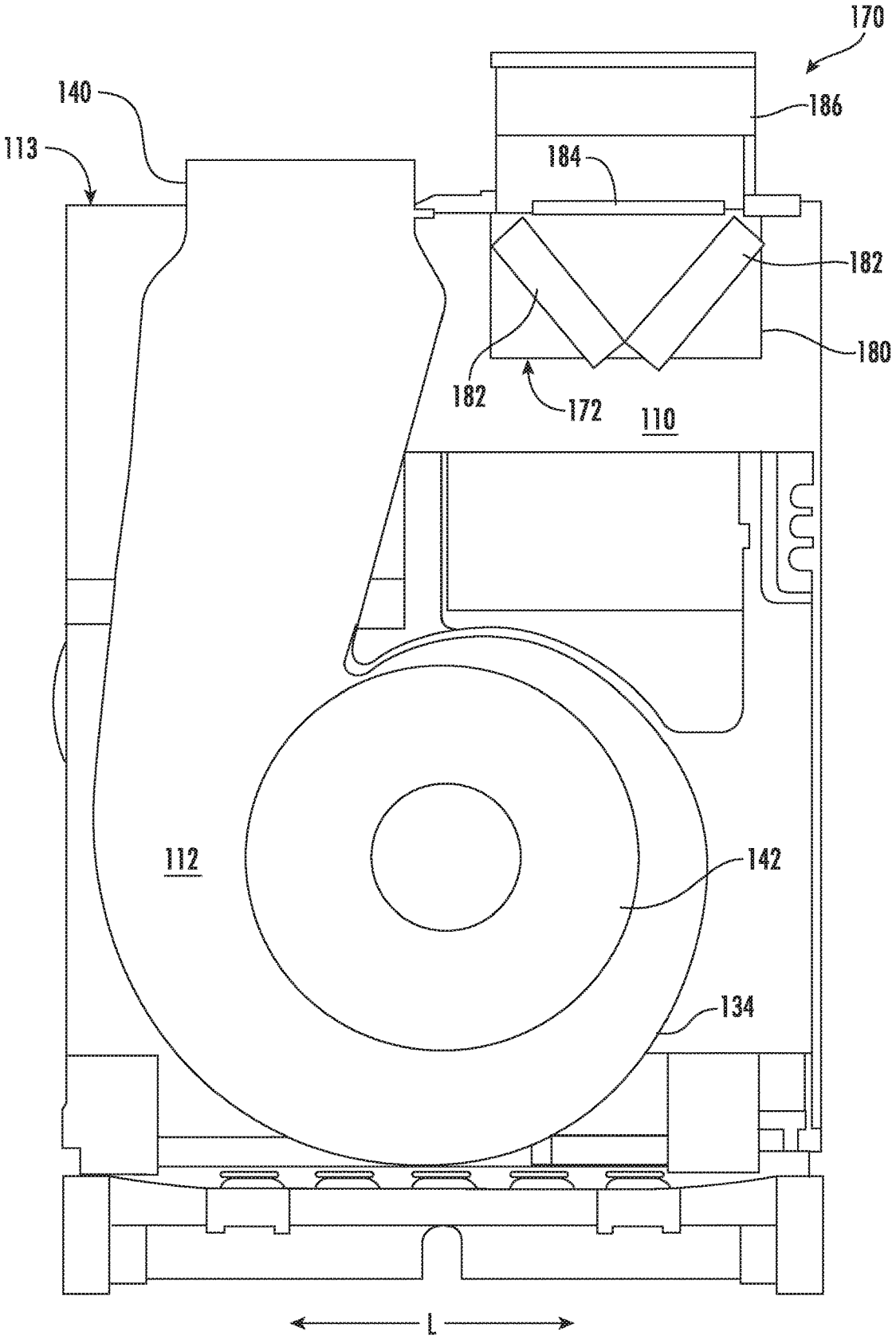
FIG. 4 provides a schematic lateral cross section view of the exemplary air conditioner unit of FIG. 1.

Turning now to the figures, FIGS. 1 through 4 illustrate an exemplary air conditioner appliance (e.g., air conditioner 100). FIG. 1 provides a perspective view of the exemplary air conditioner appliance 100. FIG. 2 provides a transverse cross section view of the exemplary air conditioner unit, e.g., the section of FIG. 2 is taken along a transverse-vertical plane defined by the transverse direction T and the vertical direction V. FIG. 3 is a top-down view of the air conditioner 100. FIG. 4 is a schematic section view taken along the section line 4-4 in FIG. 3. The line 4-4 in FIG. 3 extends along the lateral direction L, e.g., FIG. 4 is a lateral section view taken along a lateral-vertical plane defined by the lateral direction L and the vertical direction V. In some embodiments, the air conditioner 100 may be provided as a one-unit type air conditioner 100, such as a single-package vertical unit (SPVU), as illustrated, or a package terminal air conditioners (PTAC). Throughout the discussion herein, references to a "single-package air conditioner unit" are to be understood as referring to any suitable one-unit type air conditioner appliance, such as but not limited to an SPVU or a PTAC. Air conditioner 100 includes a package housing 114 supporting an indoor portion 112 (FIG. 2) and an outdoor portion 110 (FIG. 2) within an interior of the housing 114. A make-up air module 170 is positioned at least partially on an outside or exterior of the housing 114, e.g., on an external surface 113 of the housing 114, such as on a vertically upward facing top external surface 113, whereby at least a portion of the make-up air module 170 is mounted atop the housing 114.

Generally, air conditioner 100 defines a vertical direction V, lateral direction L, and transverse direction T. Each direction V, L, T is perpendicular to every other of the V, L, and T directions, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 (FIG. 2) may be enclosed within housing 114 between front opening 118 and rear opening 116. In certain embodiments, one or more components of outdoor portion 110 are mounted on a basepan 136, as shown.

During certain operations, outdoor air 1000 (FIG. 2) may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 (FIG. 2) before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122 and a blower fan 142. These components may, for example, be housed behind the front opening 118. The indoor blower fan 142 may be mounted within a fan housing 134. As illustrated for example in FIGS. 2 and 4, the fan housing 134 may include a partial circular portion in which the blower fan 142 is mounted and a transition duct portion which extends from the partial circular portion and the blower fan 142 therein to an indoor outlet 140 above the indoor fan 142. Fan housing 134 may thereby at least partially separate and define the indoor portion 112 and outdoor portion 110 within housing 114. Additionally or alternatively, fan housing 134 or indoor heat exchanger 122 may be mounted on basepan 136 (e.g., at a higher vertical position than outdoor heat exchanger 120).

During certain operations, indoor air 1002 (FIG. 2) may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 (e.g., before passing to fan housing 134). From blower fan 142, indoor air 1002 may be motivated and returned to the indoor area of the room through an indoor outlet 140 defined through housing 114 (e.g., above indoor inlet 138 along the vertical direction V) and into a vertical exhaust duct (not shown) extending upward along the vertical direction V from the housing 114. It is noted that although indoor outlet 140 is illustrated as generally directing air 1002 upward, it is understood that indoor outlet 140 and exhaust duct 141 may be defined in alternative embodiments to direct air 1002 in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136, as illustrated in FIG. 2 and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

Additionally, a plenum 200 (FIG. 2) may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). In particular, plenum 200 extends along an axial direction (e.g., parallel to the transverse direction T) through a hole or channel in the structure wall 150 that passes from an internal (indoor) surface 154 of the structure wall 150 to an external (outdoor) surface 156 of the structure wall 150. The plenum 200 may include a divider wall 256 within the plenum 200. When assembled, divider wall 256 defines a separate upper passage 258 and lower passage 260. Generally, upper passage 258 and lower passage 260 may divide or define two discrete air flow paths for air through the plenum 200. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130.

The operation of air conditioner 100 including compressor 126 (and thus the sealed system generally), blower fan 142, outdoor fan 124, and other suitable components may be controlled by a control board or controller 158. Controller 158 may be in communication with (e.g., connected to, via for example a suitable wired or wireless connection) such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162 (FIG. 3), which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display may additionally be provided in the control panel 160, and may be in communication with the controller 158. Display may, for example be a touchscreen or other text-readable display screen, or alternatively may simply be a light that can be activated and deactivated as required to provide an indication of, for example, an event or setting for the air conditioner 100.

Figure 5:
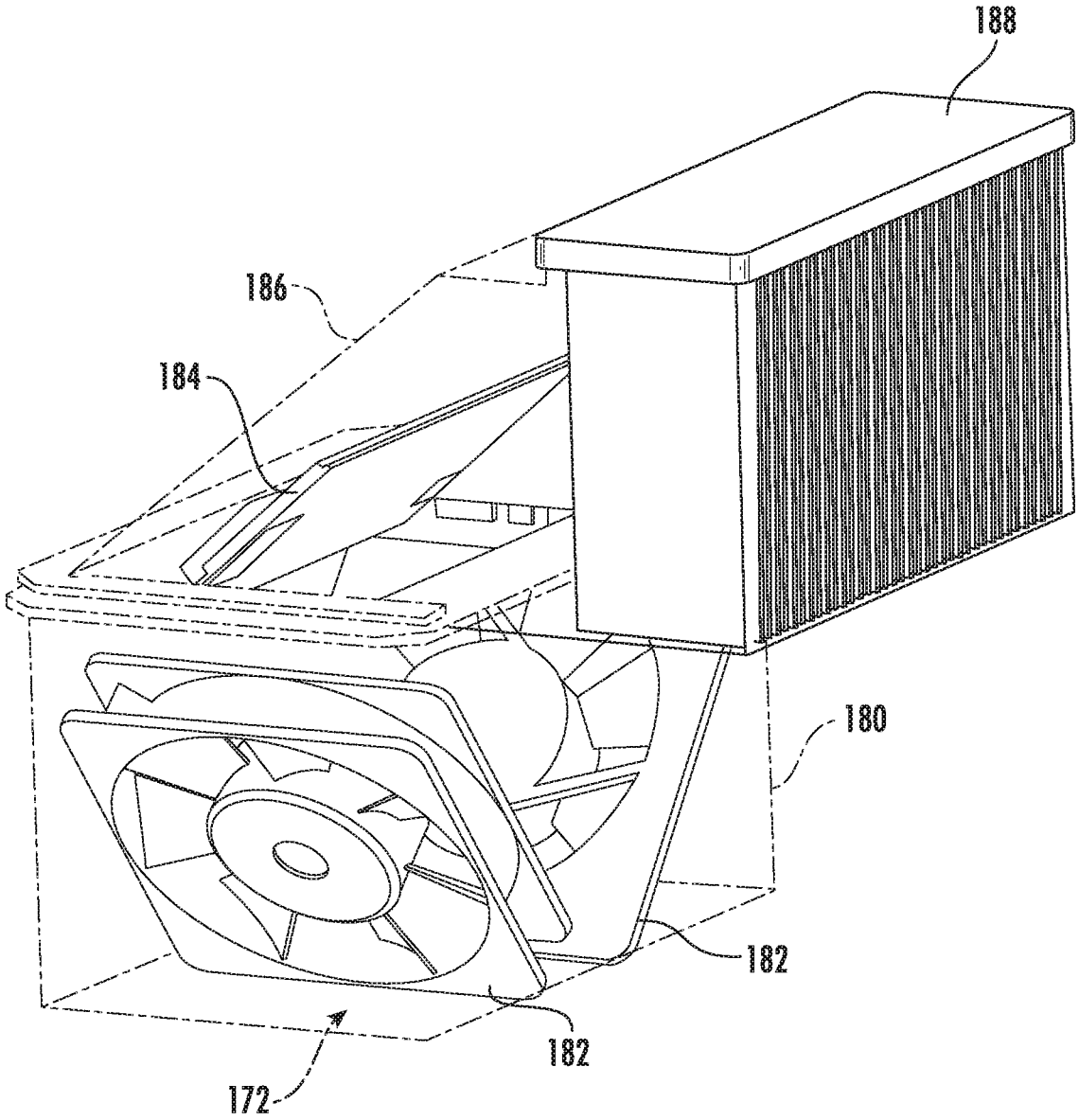
FIG. 5 provides a perspective view of a make-up air module for an air conditioning appliance according to one or more additional exemplary embodiments of the present disclosure.

Turning now to FIG. 5, an exemplary make-up air module 170 according to one or more example embodiments of the present disclosure is shown in greater detail. The make-up air module 170 is depicted in isolation in FIG. 5 (e.g., without the remainder of the air conditioner unit 100) and with external components of the make-up air module 170 illustrated in dashed lines in order to more clearly illustrate components of the make-up air module 170. As may be seen in FIG. 5, the make-up air module 170 may include a fan box 180 with a plurality of make-up air fans 182 positioned in the fan box 180. For example, the plurality of make-up air fans 182 may include two make-up air fans 182, e.g., as illustrated in FIG. 5. The make-up air module 170 may also include a vent cover 186 and a door 184 between the fan box 180 and the vent cover 186. The plurality of make-up air fans 182 may be positioned and configured for parallel flow, e.g., with no fan 182 upstream or downstream of any other fan 182 of the plurality of make-up air fans 182, such that the make-up air fans 182 collectively provide a make-up air flow.

Providing the plurality of make-up air fans 182 in parallel, e.g., rather than a single make-up air fan, may advantageously provide a quieter operation of the make-up air module 170. Quieter operation may be particularly desirable in the exemplary configurations of the air conditioner unit 100 shown and described, where the make-up air module 170 is relatively close to an occupied space, e.g., the room which is conditioned by the air conditioner unit 100, for example, in contrast to a make-up air unit which is provided separately from the air conditioner unit 100 at a remote location.

The door 184 may, in some embodiments, be a motorized door, e.g., the door 184 may be coupled to a motor and the motor may be in operative communication with and controlled by the controller 158 to move the door 184 between a closed position (FIG. 4) where the door 184 prevents or limits air flow into the vent cover 186 and an open position (FIG. 5) where the door 184 permits air flow into the vent cover 186. In some embodiments, the door 184 may rotate between the closed position and the open position. For example, the door 184 may be rotatably mounted to the housing 114, such as to a top wall 115 of the housing 114, such that the door 184 is rotatable between the closed position and the open position. In some embodiments, the door 184 may be parallel to the external surface 113 of the housing 114 when the door 184 is in the closed position, as illustrated in FIG. 4.

As may be seen, e.g., in FIGS. 2 and 4, the fan box 180 may be disposed within the housing 114, such as within the outdoor portion 110, and the vent cover 186 may be positioned outside of the housing 114. Thus, the make-up air module 170 may extend between the interior of the housing 114, e.g., the outdoor portion 110 of the housing 114, and an outside of the housing 114. For example, the make-up air module 170 may extend from an inlet 172 inside of the housing 114 to an outlet 176 outside of the housing 114. In some embodiments, the inlet 172 of the make-up air module 170 may be defined by an open bottom end of the fan box 180 and the outlet 176 may be defined by the vent cover 186. In some embodiments, the vent cover 186 of the make-up air module 170 may be mounted on an external surface of the housing 114, such as the vertically-facing external surface 113 of the top wall 115 of the housing 114. Thus, in such embodiments, the vent cover 186 of the make-up air module 170 may be mounted to the housing 114 atop the housing 114. Further, the outlet 176 of the make-up air module 170 may be positioned above the housing 114, e.g., along the vertical direction V.

In some embodiments, the make-up air module 170 may extend through the external surface 113 of the housing 114. For example, the external surface 113 may be an outer vertically upward-facing surface of a top wall 115 of the housing 114. In such example embodiments, the fan box 180 may be mounted on one side of the top wall 115, e.g., inside of the housing 114, and the vent cover 186 may be mounted to the other side of the top wall 115, e.g., at the external surface 113 of the top wall 115, whereby the make-up air module 170, which is at least partially defined by the fan box 180 and the vent cover 186 collectively, extends through the top wall 115 and through the external surface 113 thereof.

As may be seen in FIG. 2, in some embodiments, the make-up air module 170 may be in fluid communication with the outdoor portion 110 of the housing 114 to draw make-up air 1004 (which is a portion of the outside air 1000) from within the housing 114 into the make-up air module 170, e.g., via the inlet 172 of the make-up air module 170. For example, in at least some embodiments, the inlet 172 may be in direct fluid communication with the outdoor portion 110 to draw outside air (e.g., make-up air 1004 which, as mentioned, is a portion of the outside air 1000) from within the housing 114, e.g., from within the outdoor portion 110, directly into the make-up air module 170 at the inlet 172 of the make-up air module 170.

The portion of the outside air 1000 which is diverted from the exhaust flow (the exhaust flow is indicated by the left-pointing lower arrow 1000 coming out of the outdoor outlet 130 in FIG. 2) may depend at least in part on the relative capacity of the plurality of make-up air fans 182 and the outdoor fan 124. The capacity of the various fans is generally measured and described in terms of cubic feet per minute ("CFM"). For example, the plurality of make-up air fans 182 may collectively provide a make-up air flow and the outdoor fan 124 may provide an exhaust flow, and in various embodiments, the exhaust flow may be between about 300 CFM and about 900 CFM, while the make-up air flow may be between about 20 CFM and about 75 CFM. Thus, the make-up air flow may be between about two percent (2%) and about twenty-five percent (25%) of the exhaust flow, such as between about four percent (4%) and about ten percent (10%), such as about six percent (6%), or about eight percent (8%), or about five percent (5%).

In some embodiments, the outlet 176 of the make-up air module 170 may be aligned with a front surface 117 of the housing 114. For example, the outlet 176, or any other portion of the make-up air module 170, may not extend past the housing 114, e.g., may not extend past the front surface 117 of the housing 114 along the transverse direction T. Thus, in at least some embodiments, for example as illustrated in FIG. 2, where the housing 114 of the air conditioner unit 100 is spaced apart from a partition 152, e.g., a wall, access door, or access panel, which separates the air conditioner unit 100 from the room, the make-up air module 170, in particular the outlet 176 thereof, may also be spaced apart from the partition 152 and the louvers 174 defined therethrough. Thus, the make-up air 1004 may be provided from the make-up air module 170 to an indoor area (room or rooms) within the structure via the louvers 174, e.g., as illustrated in FIG. 2. Accordingly, the make-up air module 170 may be in fluid communication with the room only indirectly, e.g., air from the outlet 176 of the make-up air module 170 may pass through the ambient environment immediately around the air conditioner unit 100 before reaching the louvers 174. For example, the ambient environment immediately around the air conditioner unit 100 may be a plenum space or an interior of a closet or utility room. Accordingly, the outlet 176 of the make-up air module 170 may be in direct fluid communication with the ambient environment immediately around the air conditioner unit 100.

In some embodiments, the make-up air module 170 may include an air filter 188. For example, as illustrated in FIG. 2, the air filter 188 may be positioned in or near the outlet 176 of the make-up air module 170.

In some embodiments, e.g., as illustrated in FIG. 2, the air conditioner unit 100 may further include a resistance heater 132. In such embodiments, the compressor 126 may be a variable-speed compressor and may, for example be operatively coupled to the controller 158 such that the controller 158 may control the speed of the compressor 126, e.g., vary the speed of the compressor 126 within a greater than zero range. Also in such embodiments, each make-up air fan 182 of the plurality of make-up air fans 182 may be a variable-speed fan. Thus, such embodiments may provide dehumidification as well as ventilation to the occupied space, e.g., room. For example, in such embodiments, the air conditioner unit 100 may be operable in a cooling mode wherein the variable speed compressor 126 operates at a first speed and in a dehumidification mode wherein the variable speed compressor 126 operates at a second speed less than the first speed and greater than zero. Also in the dehumidification mode, the plurality of make-up air fans 182 may be activated and the resistance heater 132 may be activated. The dehumidification mode may be useful to avoid over-cooling the room. For example, the variable speed make-up air fans 182 may be controlled by the controller 158 such that the controller 158 can adjust, e.g., increase or decrease within a greater than zero range, the speed of the make-up air fans 182 depending on, for example, the temperature and/or humidity of the outdoor air 1000. For example, the controller 158 may adjust the speed of the fans 182 using pulse width modulation.

The make-up air module 170, e.g., the door 184 and the fans 182 thereof, may be controlled based on input from an air humidity sensor (not shown). The air humidity sensor may be positioned in the outdoor portion 110 of the housing 114, for example. When the humidity of the outdoor air 1000 exceeds a threshold, the controller 158 may operate the air conditioner unit 100 in the dehumidification mode as described above in order to thereby reduce the humidity of the make-up air 1004 provided to the indoor environment as compared to the humidity of the outdoor air 1000. The threshold may be about fifty-five percent (55%) relative humidity, where "about" includes plus or minus ten percentage points of the stated value, e.g., about 55% includes between 45% and 65%.

When the indoor room is not occupied, which may be detected by, e.g., the main control 158 or by an external control device, the door 184 is closed (e.g., actuated by a motor from the open position or an intermediate position to the closed position, where air flow into the make-up air module 170 is prevented or obstructed), the make-up air fans 182 are shut down, and the make-up air module 170 is thereby deactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan, the indoor fan mounted within a fan housing, wherein the fan housing extends to an indoor outlet;

a compressor in fluid communication with the outdoor heat exchanger and the indoor heat exchanger to circulate a refrigerant between the outdoor heat exchanger and the indoor heat exchanger; and a make-up air module extending from an inlet positioned in the outdoor portion of the housing to an outlet positioned outside of the housing, the make-up air module comprising a fan box within the outdoor portion and a plurality of make-up air fans positioned in the fan box, wherein the outlet is positioned above the housing along the vertical direction, wherein the outlet of the make-up air module is separate from the indoor outlet, and wherein the make-up air module defines a make-up air flow path that is separate from an indoor air flow path defined by the fan housing.

2. The single-package air conditioner unit of claim 1, wherein the outlet of the make-up air module is aligned with a front surface of the housing.

3. The single-package air conditioner unit of claim 1, wherein the outlet of the make-up air module is in direct fluid communication with an ambient environment immediately around the air conditioner unit.

4. The single-package air conditioner unit of claim 1, wherein the plurality of make-up air fans are positioned and configured for parallel flow.

5. The single-package air conditioner unit of claim 1, further comprising a resistance heater, wherein the compressor is a variable-speed compressor, and wherein each make-up air fan of the plurality of make-up air fans is a variable-speed fan, the air conditioner unit operable in a cooling mode wherein the compressor operates at a first speed and a dehumidification mode wherein the compressor operates at a second speed less than the first speed while the plurality of make-up air fans are activated and the resistance heater is activated.

6. The single-package air conditioner unit of claim 1, wherein the plurality of make-up air fans collectively provide a make-up air flow and the outdoor fan provides an exhaust flow, and wherein the make-up air flow is about five percent of the exhaust flow.

7. The single-package air conditioner unit of claim 1, wherein the inlet of the make-up air module is defined by an open bottom end of the fan box and the inlet is in direct fluid communication with the outdoor portion to draw outside air from within the housing directly into the make-up air module at the inlet of the make-up air module.

8. The single-package air conditioner unit of claim 5, wherein the make-up air module comprises a vent cover outside of the housing and a door between the fan box and the vent cover.

9. The single-package air conditioner unit of claim 8, wherein the outlet of the make-up air module is defined by the vent cover.

10. The single-package air conditioner unit of claim 8, wherein the vent cover of the make-up air module is mounted on an external surface of the housing.

11. The single-package air conditioner unit of claim 10, wherein the external surface of the housing is a vertically-facing surface and the vent cover is mounted to the housing atop the housing.

12. The single-package air conditioner unit of claim 1, further comprising an air filter in the outlet of the make-up air module.

13. A single-package air conditioner unit, comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan, the indoor fan mounted within a fan housing, wherein the fan housing extends to an indoor outlet;

a compressor in fluid communication with the outdoor heat exchanger and the indoor heat exchanger to circulate a refrigerant between the outdoor heat exchanger and the indoor heat exchanger; and a make-up air module extending from an inlet positioned in the outdoor portion of the housing to an outlet positioned outside of the housing, the make-up air module comprising a plurality of make-up air fans, wherein the outlet of the make-up air module is separate from the indoor outlet, wherein the make-up air module defines a make-up air flow path that is separate from an indoor air flow path defined by the fan housing.

14. The single-package air conditioner unit of claim 13, wherein the outlet is positioned above the housing and the outlet of the make-up air module is in direct fluid communication with an ambient environment immediately around the air conditioner unit.

15. The single-package air conditioner unit of claim 13, wherein the plurality of make-up air fans are positioned and configured for parallel flow.

16. The single-package air conditioner unit of claim 13, wherein the plurality of make-up air fans collectively provide a make-up air flow and the outdoor fan provides an exhaust flow, and wherein the make-up air flow is about five percent of the exhaust flow.

17. The single-package air conditioner unit of claim 13, wherein the inlet of the make-up air module is in direct fluid communication with the outdoor portion to draw outside air from within the housing directly into the make-up air module at the inlet of the make-up air module.

18. The single-package air conditioner unit of claim 13, wherein the make-up air module extends through an external surface of the housing.

19. The single-package air conditioner unit of claim 18, wherein the external surface of the housing is a vertically-facing surface.

20. The single-package air conditioner unit of claim 19, wherein the external surface of the housing is an external surface of a top wall of the housing, wherein the make-up air module further comprises a door rotatably mounted to the top wall of the housing whereby the door is rotatable between a closed position and an open position, the door parallel to the external surface of the housing when the door is in the closed position.

* * * * *